US009407017B2

(12) United States Patent
Tani

(10) Patent No.: US 9,407,017 B2
(45) Date of Patent: Aug. 2, 2016

(54) TERMINAL ATTACHMENT BASE, TERMINAL AND AUDIO APPARATUS

(71) Applicant: D&M Holdings, Inc., Kanagawa (JP)

(72) Inventor: Shunichi Tani, Fukushima (JP)

(73) Assignee: D&M Holdings, Inc., Kanagawa (JP)

( * ) Notice: Subject to any disclaimer, the term of this patent is extended or adjusted under 35 U.S.C. 154(b) by 0 days.

(21) Appl. No.: 14/764,612

(22) PCT Filed: Sep. 30, 2013

(86) PCT No.: PCT/JP2013/076489
§ 371 (c)(1),
(2) Date: Jul. 30, 2015

(87) PCT Pub. No.: WO2014/119043
PCT Pub. Date: Aug. 7, 2014

(65) Prior Publication Data

US 2015/0364840 A1 Dec. 17, 2015

(30) Foreign Application Priority Data

Jan. 30, 2013 (JP) ..... 2013-016085

(51) Int. Cl.
*H01R 4/24* (2006.01)
*H01R 4/38* (2006.01)
(Continued)

(52) U.S. Cl.
CPC .. *H01R 4/38* (2013.01); *H01R 4/48* (2013.01); *H01R 27/00* (2013.01); *H01R 2103/00* (2013.01)

(58) Field of Classification Search
CPC .. H01R 4/4818; H01R 4/4827; H01R 4/4836; H01R 2103/00; H01R 9/093; H01R 13/518; H01R 13/514; H01R 23/025; H01R 4/34; H01R 4/64; H01R 4/30; H01R 11/12; H01R 11/26; H01R 33/22; H04Q 1/142; G02B 6/3897; F21S 8/00; F21S 6/001; F21V 19/006; F16B 35/044
USPC ..... 439/441, 540.1, 801, 543
See application file for complete search history.

(56) References Cited

U.S. PATENT DOCUMENTS 3,153,119 A * 10/1964 Hart ..... F21S 4/10 156/49
4,071,696 A * 1/1978 Anderson ..... H04M 1/0293 379/332

(Continued)

FOREIGN PATENT DOCUMENTS

JP 137565/1987 UM 8/1987
JP 106705/1989 UM 4/1991

(Continued)

OTHER PUBLICATIONS

International Search Report for PCT/JP2013/076489, dated Dec. 3, 2013.

*Primary Examiner* — Abdullah Riyami
*Assistant Examiner* — Vladimir Imas
(74) *Attorney, Agent, or Firm* — Peter A. Nieves; Sheehan Phinney Bass & Green PA

(57) ABSTRACT

[Problem] To achieve compatibility between push-type and screw-type terminals of mounted printed circuit substrates. [Solution] A speaker terminal attachment base (1) allows both push- and screw-type connectors (2, 3) to be attached thereto. A connector anchoring boss part (111), whereby a terminal part (121) with a through hole (1211) is anchored, is formed upon an attachment base (1), and a through hole (1112), which connects to the through hole (1211) of the terminal part (121), is formed upon the connector anchoring boss part (111). The through hole (1112) comprises a large diameter part (11121), and a small diameter part (11122). When the screw-type connector (3) is attached, a nut (5) which sends a male screw part (312) of the connector (3) in the axial direction is non-rotatably housed in the large diameter part (11121) before a terminal plate (12) is attached. When the push-type connector (2) is attached, a flat face (11123) which is formed in the inner circumference of the small diameter part (11122) makes planar contact with a flat face (2115) of the connector (2), preventing the rotation of the connector (2).

5 Claims, 4 Drawing Sheets

(51) Int. Cl.

| | |
|---|---|
| ***H01R 4/48*** | (2006.01) |
| ***H01R 27/00*** | (2006.01) |
| *H01R 103/00* | (2006.01) |

(56) References Cited

U.S. PATENT DOCUMENTS 4,103,983 A * 8/1978 Morrison ..... B60R 11/0205 248/201
4,806,108 A * 2/1989 Meinhardt ..... H01R 4/64 439/100
4,974,888 A * 12/1990 Childers ..... F16B 37/0857 292/251
5,007,860 A * 4/1991 Robinson ..... H01R 13/514 439/535
5,106,325 A * 4/1992 Robinson ..... H01R 13/514 439/535
5,476,729 A * 12/1995 Miller, Jr. ..... H01M 2/1055 429/1
5,522,735 A * 6/1996 Wright ..... H01R 13/567 439/468
6,146,192 A * 11/2000 Cabalka ..... H01R 13/73 439/540.1
6,179,653 B1 * 1/2001 Cheng ..... H01R 12/716 439/541.5
6,319,078 B1 * 11/2001 Thorner ..... H01R 11/12 439/883
6,636,663 B2 * 10/2003 Lindsey ..... G02B 6/262 385/33
6,719,581 B2 * 4/2004 Kikuchi ..... H04R 5/04 439/441
6,790,080 B2 * 9/2004 Cannon ..... H01R 13/622 439/540.1
7,029,286 B2 * 4/2006 Hall ..... H01R 13/506 439/357
7,284,912 B2 * 10/2007 Suzuki ..... G02B 6/3807 385/60
7,303,432 B1 * 12/2007 Chen ..... H01R 13/518 439/540.1
7,316,582 B2 * 1/2008 Fan ..... H01R 13/508 439/540.1
7,326,091 B2 * 2/2008 Nania ..... H01R 13/6599 439/681
7,710,733 B2 * 5/2010 Neumetzler ..... H04Q 1/142 361/728
7,806,722 B2 * 10/2010 Yu ..... H01R 13/648 439/540.1
7,914,323 B2 * 3/2011 Hung ..... H01R 13/514 439/540.1
7,946,733 B2 * 5/2011 Ashida ..... G02B 6/4298 362/296.09
8,073,184 B2 * 12/2011 Horigome ..... H04R 1/06 381/386
8,096,827 B2 * 1/2012 Kleinkorres ..... H01R 13/745 439/540.1
8,444,443 B2 * 5/2013 Schafmeister ..... H01R 4/4836 439/441
8,657,462 B2 * 2/2014 Schwalenberg ..... F21S 6/001 315/294
8,845,166 B2 * 9/2014 Lederer ..... F21L 4/08 362/569
8,878,102 B2 * 11/2014 Juarez ..... H01R 33/22 219/209
8,958,591 B2 * 2/2015 Hagman ..... H04R 1/025 353/18
9,124,031 B2 * 9/2015 Su ..... H01R 13/6277
2002/0182924 A1 * 12/2002 Mo ..... H01R 13/6273 439/358

FOREIGN PATENT DOCUMENTS

JP 2004127823 A 4/2004
JP 2007135043 A 5/2007
JP 3160458 U 6/2010

* cited by examiner

TERMINAL ATTACHMENT BASE, TERMINAL AND AUDIO APPARATUS

TECHNICAL FIELD

The present invention relates to a terminal suited for use as a speaker terminal in an audio device, such as an audio amplifier and an audio receiver, and more particularly, to the structure of a terminal also usable as any of a push-type connector and a screw-type connector.

BACKGROUND ART

As a speaker terminal to be arranged on a rear panel and the like of an audio device, such as an audio amplifier and an audio receiver, there are known a screw-type speaker terminal, in which a speaker cable is pressed against a terminal component by fastening a male screw part formed on an outer peripheral surface of a shaft into a female screw, and a push-type speaker terminal, in which a speaker cable inserted into a cable insertion hole of a stud electrically connected to a terminal component is pressed against an inner wall of the cable insertion hole by a restoring force of a compressed spring.

For example, in Patent Literature 1, a screw-type speaker terminal is described. This speaker terminal includes a connector part including a shaft having a male screw formed on an outer peripheral surface of the shaft, a bottomed tubular terminal component having a female screw cut into an inner peripheral surface thereof, into which the male screw of the shaft of the connector part is fastened, and a housing including a tubular part into which the terminal component is to be fitted and fixed.

Cable insertion ports connecting the outside of the tubular part of the housing to an internal space of the terminal component are formed in the tubular part of the housing and in the terminal component fitted into the tubular part. A tip portion of the cable is inserted from the cable insertion ports and is received in the internal space of the terminal component. Further, a press-contact surface of the shaft tip is guided toward the bottom surface of the terminal component by tightening the male screw on the shaft outer peripheral surface and the female screw in the terminal component inner peripheral surface together so that the tip portion of the cable received in the internal space of the terminal component is pressed against the bottom surface of the terminal component.

On the other hand, in Patent Literature 2, a push-type speaker terminal is described. The speaker terminal includes a flat plate-shaped housing, a plate-shaped terminal member mounted to a front surface of the housing, and a push-type connector part mounted to the front surface of the housing across the terminal member. The push-type connector part includes a stud with a cable insertion hole, in which the terminal member is electrically connected to one end portion of the stud, and a cap with a cable insertion hole, which is placed on another end portion of the stud. Generally, the end portion of the speaker cable, which is inserted into the cable insertion hole of the stud through the cable insertion hole of the cap pushed onto the stud while compressing a spring, is pushed against the inner wall of the cable insertion hole of the stud due to the cap being pushed back by the restoring force of the spring.

CITATION LIST

Patent Literature

[PTL 1] JP 2004-127823 A
[PTL 2] JP 2007-135043 A

SUMMARY OF INVENTION

Technical Problem

For example, the type of speaker terminal to be used may be different for each product model segment, such as an intended market and a class. However, the screw-type speaker terminal and the push-type speaker terminal both include a specific housing, and hence in many cases cannot be connected to a common printed circuit board (PCB). Therefore, a PCB-compatible design cannot be achieved among different product model segments, thereby causing deterioration in design efficiency. Further, a common PCB cannot be shared among different product model segments, thereby causing increase in production costs.

The present invention has been made in view of the circumstances described above. It is an object of the present invention to provide a common printed circuit board to which a push-type terminal and a screw-type terminal can be mounted.

Solution to Problem

In order to attain the object described above, according to one embodiment of the present invention, there is provided a terminal mounting base to which two connectors each being configured to electrically connect an externally inserted cable and a terminal member to each other are to be mounted, the terminal mounting base including:

two of the terminal members arranged corresponding to the two connectors, respectively; and a housing including terminal fixing parts for the two of the terminal members, which are configured to fix the two of the terminal members, the housing being configured so that, as the two connectors, a screw-type connector and a push-type connector are mountable to the housing, each of the two of the terminal members having a through hole formed therein, each of the terminal fixing parts of the housing having a stepped through hole formed therein to be connected to the through hole of the each of the two of the terminal members, the stepped through hole including:

a first hole portion configured to receive a nut threadedly engageable onto, when a metal member of the screw-type connector is inserted into the stepped through hole of the each of the terminal fixing parts through the through hole of the each of the two of the terminal members, a screw part formed on the metal member so that the screw-type connector is moved in a direction in which the externally inserted cable is pushed against the each of the two of the terminal members, or in a direction in which the externally inserted cable is moved away from the each of the two of the terminal members; and a second hole portion having a smaller diameter than the first hole portion, the second hole portion including a rotation stopping portion formed in an inner wall thereof, which is configured to prevent rotation of the push-type connector by coming into contact with, when a metal member of the push-type connector is inserted into the stepped through hole of the each of the terminal fixing parts through the through hole of the each of the two of the terminal members, a rotation stopped portion formed on the metal member.

Further, according to one embodiment of the present invention, there is provided a terminal, including:

the above-mentioned terminal mounting base; and a push-type connector or a screw-type connector, which is mounted to the terminal mounting base.

Further, according to one embodiment of the present invention, there is provided an audio device, including:

a plurality of the above-mentioned terminals, the plurality of the terminals being arranged in a line so that the cable insertion port of the each of the resin covers of the two connectors is oriented in an upward direction.

Advantageous Effects of Invention

According to the one embodiment of the present invention, any of the push-type connector and the screw-type connector can be mounted to the common housing. As a result, it is possible to provide the common printed circuit board to which the push-type terminal and the screw-type terminal can be mounted.

DESCRIPTION OF EMBODIMENTS

An embodiment of the present invention is now described with reference to the drawings based on an example in which the present invention is applied to a speaker terminal.

The speaker terminal according to this embodiment may be applied as any one of push-type and screw-type (binding post-type) speaker terminals 100A and 100B by selectively mounting a push-type connector 2 and a screw-type connector 3. Specifically, the speaker terminals 100A and 100B according to this embodiment each include a mounting base 1 to which both the push-type and screw-type connectors 2 and 3 may be mounted. First, after describing the configuration of the mounting base 1, which is a common component of the push-type speaker terminal 100A and the screw-type speaker terminal 100B, the overall configuration of each of the push-type and screw-type speaker terminals 100A and 100B is described.

Figure 1A:
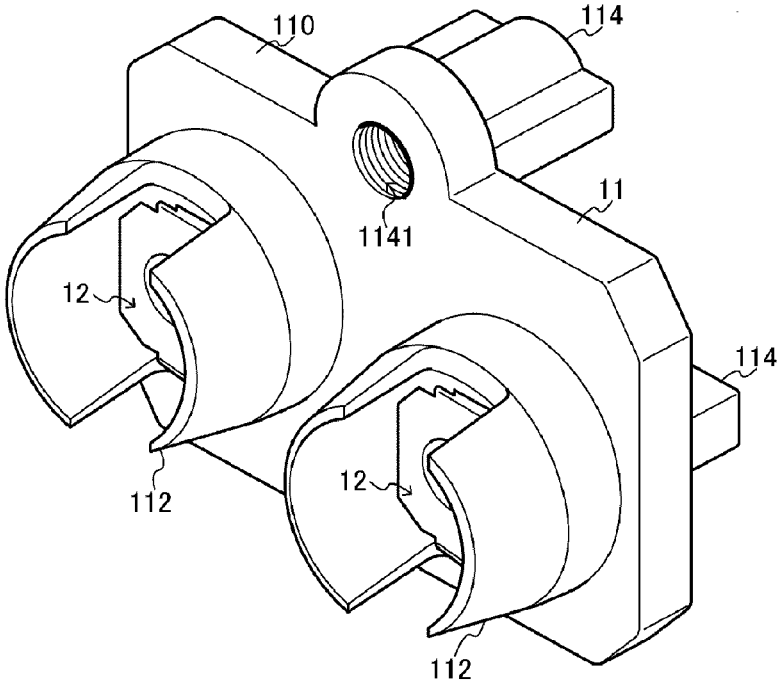
FIG. 1(A) is an external view of a mounting base 1 of a speaker terminal 100A or 100B according to an embodiment of the present invention.
Figure 1B:
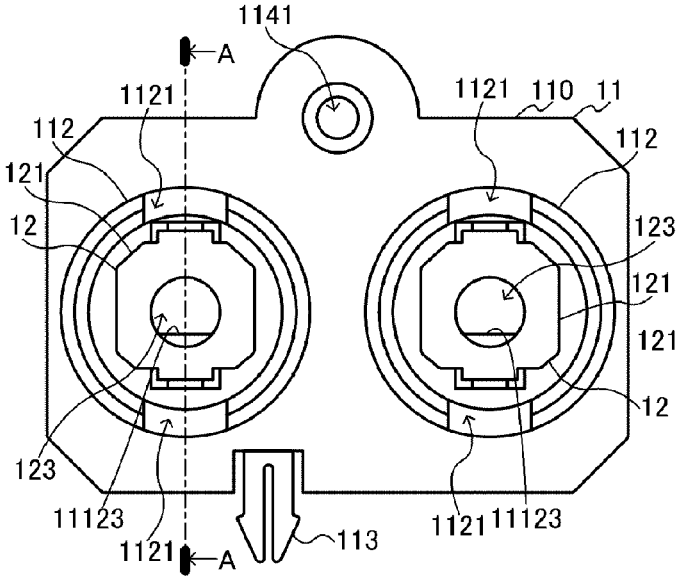
FIG. 1(B) is a front view of the mounting base 1 illustrated in FIG. 1(A)
Figure 1C:
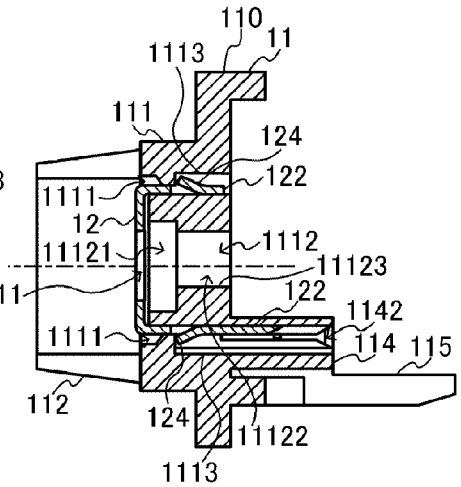
FIG. 1(C) is a cross-sectional view of the mounting base 1 taken along the line A-A in FIG. 1(B).

FIG. 1(A) is an external view of the mounting base 1 of the speaker terminal 100A or 100B according to this embodiment, FIG. 1(B) is a front view of the mounting base illustrated in FIG. 1(A), and FIG. 1(C) is a cross-sectional view of the mounting base 1 taken along the line A-A in FIG. 1(B).

As illustrated in FIG. 1, the mounting base 1 includes two terminal plates 12, three lugs (two terminal lugs and one earth lug) (not shown), and a housing 11 to which those metal members are fixed.

The two terminal plates 12 each integrally include a rectangular terminal part 121 and two leg parts 122 extending from both ends of the terminal part 121.

The terminal part 121 is arranged on an end surface of a connector fixing boss part 111 of the housing 11. A through hole 1211 connecting to a stepped through hole 1112 formed in the connector fixing boss part 111 of the housing 11 is formed in the terminal part 121 as an insertion hole 123 for a stud 21 (see FIG. 2) of the push-type connector 2 or a screw part 312 (see FIG. 3) of the screw-type connector 3.

The two leg parts 122 are bent from the terminal part 121, and inserted into terminal insertion slots 1111 formed in the connector fixing boss part 111 of the housing 11. Each of the leg parts 122 has a sideways U-shaped cutout open to the terminal part 121 side. A locking claw 124 is formed by bending a strip-shaped portion surrounded by the cutout. As described later, when the leg parts 122 are inserted into the terminal insertion slots 1111, the locking claw 124 abuts against an end surface of a groove 1113 formed in an inner wall surface of the terminal insertion slot 1111, which prevents the leg parts 122 from slipping out from the two terminal insertion slots 1111. As a result, the terminal part 121 is fixed to the end surface of the connector fixing boss part 111 of the housing 11.

The housing 11 integrally includes a plate-shaped housing body 110, a snap-fit part 113 formed on one surface (back surface) of the housing body 110, two connector fixing boss parts 111 formed on another surface (front surface) of the housing body 110, and a tubular cover part 112 configured to surround each of the connector fixing boss parts 111. In addition, although not all are shown, in order to fix the three lugs, for each lug, a lug fixing boss part 114 for fixing one end portion (end portion to be connected to the terminal plate 12) of the lug, and a two-pronged lug holding part 115 configured to position another end portion (end portion to be connected to a PCB hole) of the lug at a position determined based on a layout of the holes in the PCB are integrally formed on the back surface of the housing body 110.

The housing body 110 is arranged at a predetermined position in a case of the audio device so that the front surface of the housing body 110 faces the back surface of the rear panel of the audio device. The snap-fit part 113 is fitted into a predetermined locking hole formed in the PCB, for example. In addition, the PCB is mounted to a predetermined position in the case of the audio device. As a result, the housing body 110 is fixed to the case of the audio device in this posture.

The stepped through hole 1112 connecting to the back surface of the housing body 110 and the two terminal insertion slots 1111, which are arranged facing each other across the stepped through hole 1112, are formed in an end surface of each of the two connector fixing boss parts 111.

The stepped through hole 1112 includes a large-diameter portion 11121, which has a larger diameter than the through hole 1211 of the terminal part 121, and a small-diameter portion 11122, which is positioned on the back surface side of the housing body 110 with respect to the large-diameter portion 11121. When the screw-type connector 3 is to be mounted to the mounting base 1, a nut 5 that moves a male screw part 312 of the connector 3 in an axial direction is received in the large-diameter portion 11121 before mounting the terminal plate 12 (see FIG. 3). On an inner peripheral surface of the large-diameter portion 11121, for example, a flat surface facing at least one of six flat surfaces formed on the outer periphery of the nut 5 is formed. The nut 5 is prevented from rotating in the large-diameter portion 11121 due to this flat surface coming into surface contact with the flat surface of the outer periphery of the nut 5. On the other hand, a flat surface 11123 for stopping rotation is formed in the axial direction on an inner periphery of the small-diameter portion 11122. When mounting the push-type connector 2 to the mounting base 1, a fixing part 2112 of the connector 2 is press-fitted into the small-diameter portion 11122. As a result, a nut 4 is fastened onto a screw part 212 of the connector 2 protruding on the back surface side of the housing body 110. At this point, the flat surface 11123 on the inner periphery of the small-diameter portion 11122 is in surface contact with a flat surface 2115 formed on the outer periphery of the fixing part 2112 of the push-type connector 2, which prevents the push-type connector 2 from rotating with respect to the housing body 110 (see FIG. 2).

Of the inner wall surfaces of each of the terminal insertion slots 1111, the wall surface facing the locking claw 124 of the leg part 122 of the terminal plate 12 has the groove 1113 formed therein from a position in the terminal insertion slot 1111 toward an insertion direction of the leg part 122 of the terminal plate 12 (back surface side of the housing body 110). When the two leg parts 122 of the terminal plate 12 are inserted into the respective terminal insertion slots 1111, the locking claw 124 of each of the leg parts 122 is elastically deformed in a flat direction based on the width of the terminal insertion slot 1111. When the locking claw 124 reaches the position of the groove 1113 in the inner wall of the terminal insertion slot 1111, the locking claw 124 is raised up in an amount equal to the depth of the groove 1113. As a result, the locking claw 124 of each of the two leg parts 122 abuts against the end portion of the groove 1113, which prevents the leg parts 122 from slipping out from the two terminal insertion slots 1111. As a result, the terminal part 121 is fixed to the end surface of the connector fixing boss part 111 of the housing 11.

Each cover part 112 includes two cable insertion ports 1121 formed in a direction substantially perpendicular to the direction of the arrangement of the connector fixing boss parts 111. The two cable insertion ports 1121 are formed facing each other across the connector fixing boss part 111. The cable insertion part of the connector 2 or 3, which may be any one of the push-type and screw-type connectors, is also arranged on an inner side of the cover part 112, and hence a core of the speaker cable is inserted into the cable insertion part of the connector 2 or 3 through the cable insertion port 1121 of the cover part 112.

In one of the three lug fixing boss parts 114, a screw hole 1141 passing from the front surface of the housing body 110 to the end surface of the lug fixing boss part 114 is formed. Further, a lug insertion slot (not shown) intersecting the screw hole 1141 is formed in an end surface of the lug fixing boss part 114, and one end portion of the earth lug is fitted into the lug insertion slot. A screw 6 (see FIG. 4) inserted in a through hole formed in the rear panel 7 of the audio device is fastened into the screw hole 1141. As a result, the housing body 110 is fixed to the back side of the rear panel 7 of the audio device, and the one end portion of the earth lug is grounded to the case of the audio device by being electrically connected to the tip of the screw in the screw hole 1141.

Each of the other two lug fixing boss parts 114 is formed at a position on the opposite side (back surface side of the housing body 110) of the connector fixing boss part 111 across the housing body 110. On an end surface of each of those lug fixing boss parts 114, there is formed a lug insertion slot 1142 connected to one of the two terminal insertion slots 1111 of the corresponding connector fixing boss part 111. One end portion of each of the two terminal lugs is fitted into the lug insertion slot 1142 of the lug fixing boss part 114, and is electrically connected to the leg part 122 of the terminal plate 12 inserted in the corresponding terminal insertion slot 1111.

The three lugs each having one end portion fixed in this manner to each of the lug fixing boss parts 114 are bent in a predetermined direction toward the lug holding parts 115. Each lug holding part 115 holds the corresponding lug, and guides the another end portion thereof to a position determined based on the layout of the holes in the PCB. Further, when the snap-fit part is fitted into an engaging hole formed in the PCB, the another end portion of each of the three lugs is electrically connected to a predetermined hole in the PCB.

Next, the configuration of the push-type and screw-type speaker terminals 100A and 100B using such a mounting base 1 is described.

(1) Push-Type Speaker Terminal 100A

Figure 2A:
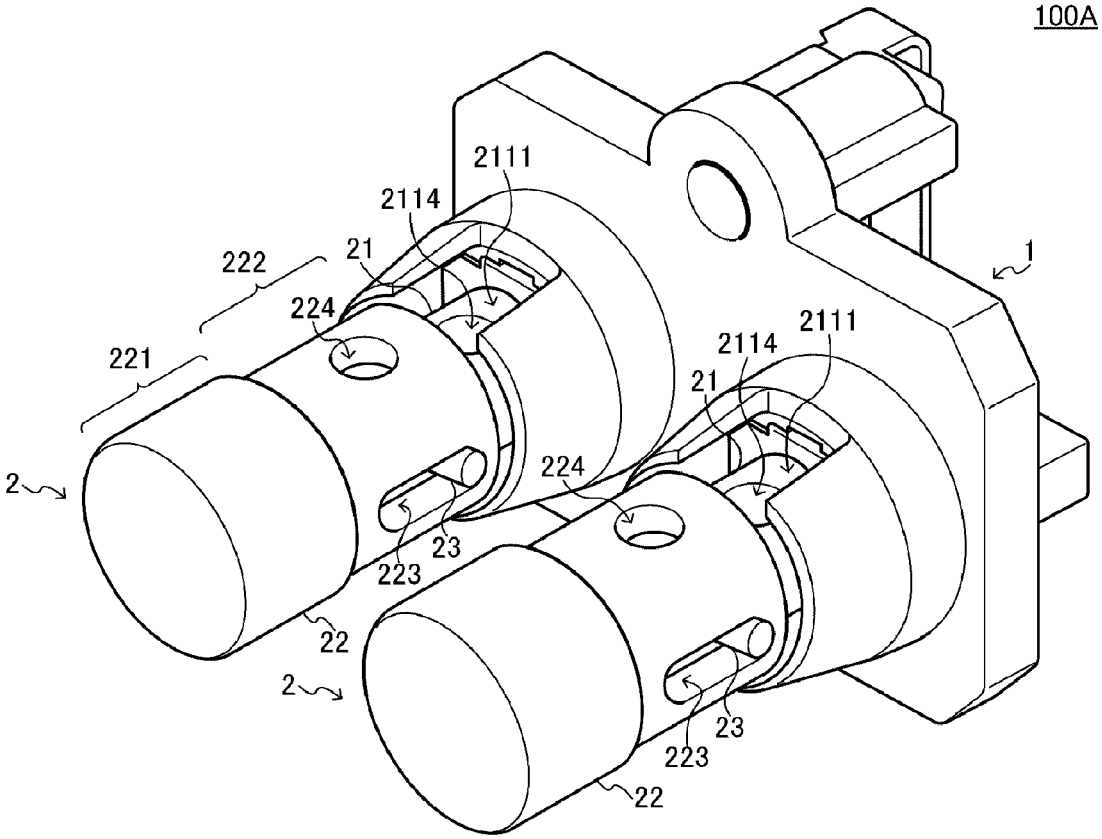
FIG. 2(A) is an external view of the push-type speaker terminal 100A according to an embodiment of the present invention.
Figure 2B:
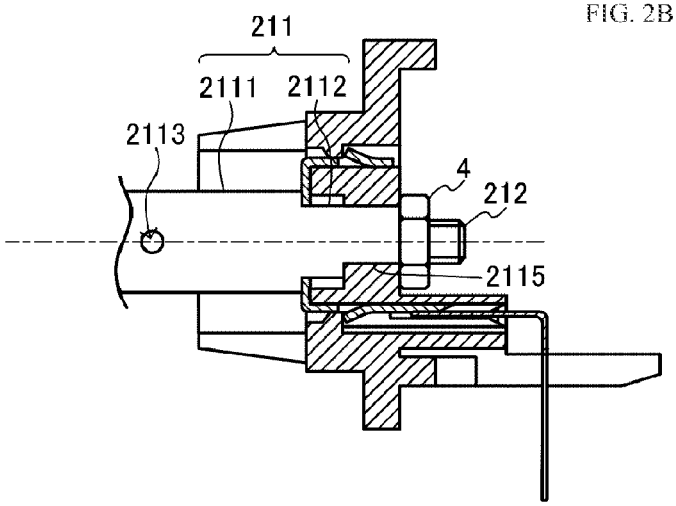
FIG. 2(B) is a cross-sectional view of a mounting part of a push-type connector 2 for the speaker terminal 100A.

FIG. 2 (A) is an external view of the push-type speaker terminal 100A according to this embodiment, and FIG. 2 (B) is a cross-sectional view of a mounting part of the push-type connector 2 for the speaker terminal 100A.

As illustrated in the figures, the push-type speaker terminal 100A according to this embodiment includes two push-type connectors 2, the above-mentioned mounting base 1, and the nut 4 for fixing each connector 2 to the mounting base 1.

The push-type connector 2 used herein includes the metal stud 21, a cylindrical resin cap 22 pushably placed on one end portion of the stud 21, an elastic member (not shown), such as a spring, arranged between one end surface of the stud 21 and a top part 221 of the cap 22, and a latch 23 configured to restrict movement of the cap 22 with respect to the stud 21 to a predetermined range.

The stud 21 includes a stepped columnar shaft part 211 and the male screw part 212 integrally formed with one end surface of the shaft part 211.

The shaft part 211 includes two cylindrical parts having different diameters from each other. Specifically, the shaft part 211 includes a large-diameter portion 2111 and a small-diameter portion 2112 arranged between the large-diameter portion 2111 and the male screw part 212. The large-diameter portion 2111 functions as a cap holding part 2111 on which the cap 22 is placed. The small-diameter portion 2112 functions as the fixing part 2112 to be press-fitted into the small-diameter portion 11122 of the stepped through hole 1112 of the connector fixing boss part 111 through the through hole 123 of the terminal part 121.

On the outer periphery of the cap holding part 2111, there are formed a latch insertion hole 2113 that passes through the cap holding part 2111 in a radial direction, and a cable insertion hole 2114 that passes through the cap holding part 2111 in a radial direction substantially perpendicular to the direction of the latch insertion hole 2113. The latch 23 is inserted and fixed in the latch insertion hole 2113 through guide holes 223 (described below) each formed in the axial direction in a side surface of the cap 22 placed on one end portion of the cap holding part 2111. In this case, both the end portions of the latch 23 protrude from both sides of the latch insertion hole 2113, and each end portion of the latch 23 is arranged in the guide hole 223 of a cylindrical part 222 of the cap 22. As a result, the cap 22 slides in an axial direction of the cap holding part 2111 over the range that the latch 23 moves within the guide hole 223. Consequently, a user can align the position of a cable insertion port 224 (described below) formed in a side surface of the cap 22 with the cable insertion hole 2114 of the cap holding part 2111 by pushing the cap 22.

On an outer peripheral surface of the fixing part 2112, the flat surface 2115 for stopping rotation is formed in the axial direction of the fixing part 2112 at a position in a predetermined positional relationship with the cable insertion hole 2114. The flat surface 2115 positions both openings of the cable insertion hole 2114 of the cap holding part 2111 to face the cable insertion ports 1121 of the cover part 112, and prevents the stud 21 from rotating with respect to the housing body 110, by coming into surface contact with the flat surface 11123 formed on the inner periphery of the small-diameter portion 11122 of the stepped through hole 1112 of the connector fixing boss part 111. Further, the fixing part 2112 is formed so as to be shorter than the thickness of the connector fixing boss part 111. As a result, when the fixing part 2112 is press-fitted into the small-diameter portion 11122 of the stepped through hole 1112 of the connector fixing boss part 111 until the terminal part 121 is sandwiched between a step surface formed between the cap holding part 2111 and the fixing part 2112 and the front surface on the large-diameter portion 11121 side of the connector fixing boss part 111, the male screw part 212 protrudes on the back surface side of the housing body 110.

The cap 22 integrally includes the cylindrical part 222 into which the cap holding part 2111 of the stud 21 is inserted, and the top part 221 blocking one end of the cylindrical part 222. An elastic member, such as a spring, is received in the top part 221. When the cap 22 is pushed onto the one end portion of the cap holding part 2111 of the stud 21, the elastic member is compressed by the top part 221 and one end surface of the cap holding part 2111, and the cap 22 is pushed back by the restoring force of the elastic member.

The cylindrical part 222 includes the two guide holes 223 defining the movement range of the latch 23 and the cable insertion port 224. The two guide holes 223, which are each formed along the axial direction of the cap 22, are elongated holes facing each other. Both end portions of the latch 23 are arranged on the inner side of the two guide holes 223. As a result, the movement of the latch 23 is restricted to a predetermined range. The cable insertion port 224 is formed at a position that passes above the cable insertion hole 2114 of the cap holding part 2111 when the cap 22 slides across the movable range of the latch 23.

The push-type connector 2 as described above is mounted to the mounting base 1 as follows.

The flat portion 2115 formed on the outer peripheral surface of the small-diameter portion 2112 of the stud 21 is caused to face the flat surface 11123 side formed on the inner periphery of the small-diameter portion 11122 of the stepped through hole 1112 of the connector fixing boss part 111, and the stud 21 protruding from the cap 22 is inserted into the stepped through hole 1112 of the connector fixing boss part 111 on the inner side of the cover part 112 through the through hole 123 of the terminal part 121. Further, the fixing part 2112 is press-fitted into the small-diameter portion 11122 of the stepped through hole 1112 of the connector fixing boss part 111 until the terminal part 121 is sandwiched between the step surface formed between the cap holding part 2111 of the stud 21 and the fixing part 2112 and the front surface on the large-diameter portion 11121 side of the stepped through hole 1112 of the connector fixing boss part 111. In this case, because the flat portion 2115 formed on the outer periphery of the small-diameter portion 2112 of the stud 21 comes into surface contact with the flat surface 11123 formed on the inner periphery of the small-diameter portion 11122 of the stepped through hole 1112 of the connector fixing boss part 111, both openings of the cable insertion hole 2114 of the cap holding part 2111 are positioned facing the cable insertion ports 1121 of the cover part 112, and rotation of the stud 21 with respect to the housing is prevented.

The male screwpart 212 of the stud 21 is caused to protrude on the back surface side of the housing body 110 from the stepped through hole 1112 of the connector fixing boss part 111 by press-fitting the fixing part 2112 into the small-diameter portion 11122 of the stepped through hole 1112 of the connector fixing boss part 111. When the nut 4 is fastened onto the male screw part 212, the stud 21 is in secure close contact with the terminal part 121, and the push-type connector 2 is fixed to the housing body 110 in a posture in which both openings of the cable insertion hole 2114 of the cap holding part 2111 face the cable insertion ports 1121 of the cover part 112.

In this state, except for an exposed area from the cable insertion ports 1121 of the cover part 112, the stud 21 protruding from the cap 22 is covered by the cover part 112 and the cap 22. As a result, when connecting a cable, the stud 21, which is a hot metal part, can be more reliably prevented from coming into contact with the terminal part of the connection cable, such as an HDMI (trademark) cable and a USB cable.

(2) Screw-Type Speaker Terminal 100B

Figure 3A:
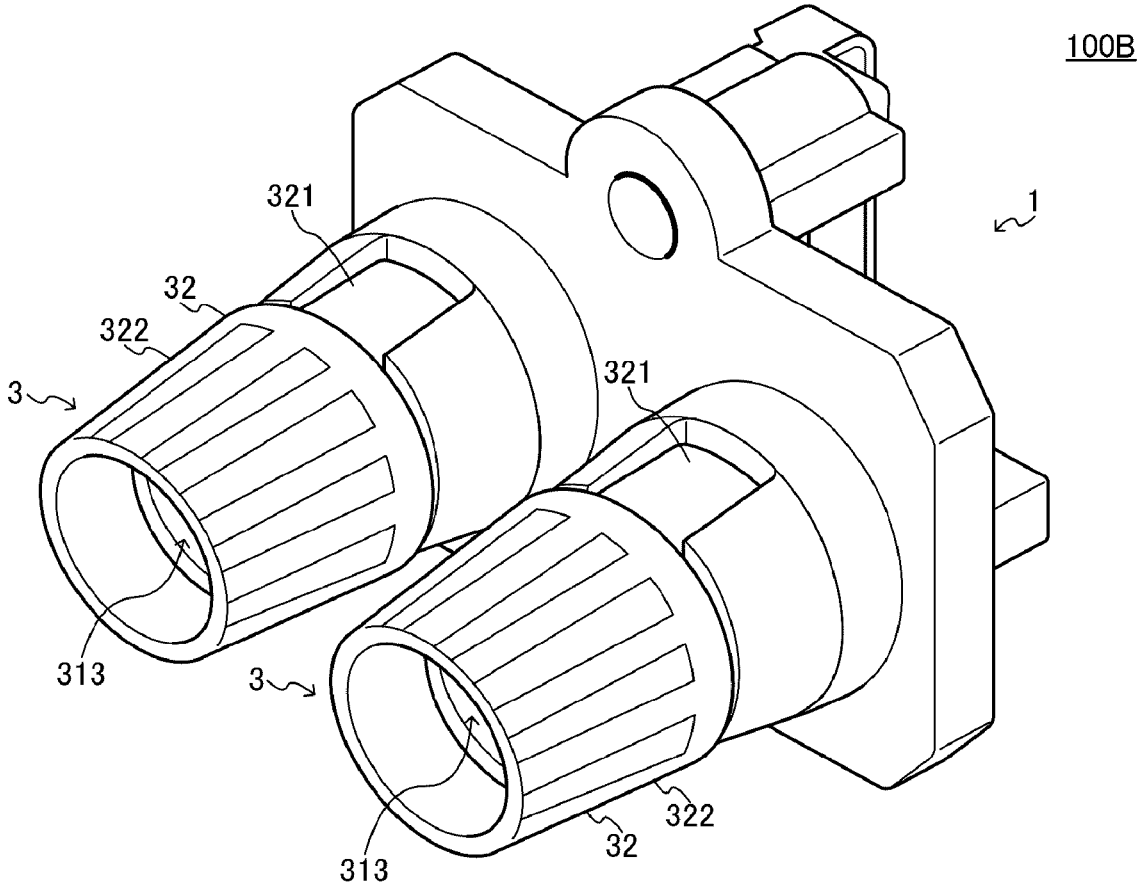
FIG. 3(A) is an external view of the screw-type speaker terminal 100B according to an embodiment of the present invention.
Figure 3B:
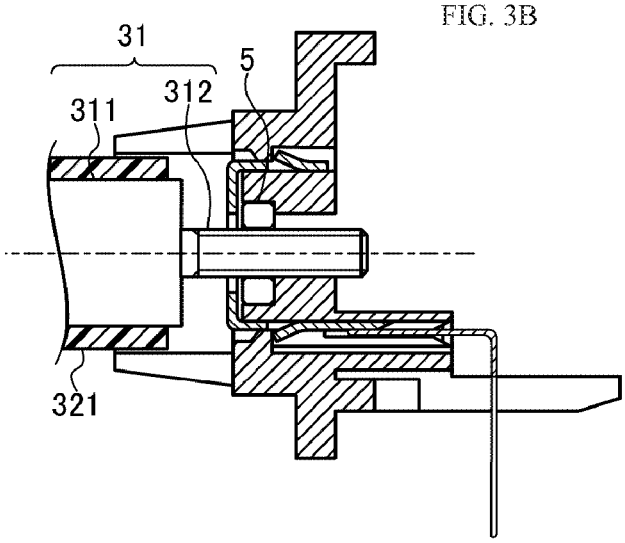
FIG. 3(B) is a cross-sectional view of a mounting part of a screw-type connector 3 for the speaker terminal 100B.

FIG. 3(A) is an external view of the screw-type speaker terminal 100B according to this embodiment, and FIG. 3(B) is a cross-sectional view of a mounting part of the screw-type connector 3 for the speaker terminal 100B.

As illustrated in the figures, the screw-type speaker terminal 100B according to this embodiment includes two screw-type connectors 3, the above-mentioned mounting base 1, and the nut 5 for moving each connector 3 in the axial direction.

The screw-type connector 3 used herein includes a metal stud 31 and a resin knob 32 covering an outer peripheral surface of the stud 31.

The stud 31 includes a shaft part 311 having a banana plug insertion port 313 formed on one end surface thereof, and a male screw part 312 integrally formed with another end surface of the shaft part 311.

The knob 32 has a stepped cylindrical shape covering the outer peripheral surface of the shaft part 311. Specifically, the knob 32 includes a small-diameter portion 321 having an outer diameter that is smaller than the inner diameter of the cover part 112, and a large-diameter portion 322 positioned on the banana plug insertion port 313 side with respect to the small-diameter portion 321. One end surface of the shaft part 311 (banana plug insertion port 313) is exposed from an end portion of the large-diameter portion 322 of the knob 32, and another end surface of the shaft part 311 and the male screw part 312 protrude from an end portion of the small-diameter portion 321 of the knob 32.

The screw-type connector 3 as described above is mounted to the mounting base 1 as follows.

In this case, after the nut 5 that moves the screw part 312 of the connector 3 in the axial direction is fitted into the large-diameter portion 11121 of the stepped through hole 1112 of the connector fixing boss part 111, the terminal part 121 is fixed to an upper surface of the connector fixing boss part 111.

The male screw part 312 protruding from the small-diameter portion 321 of the knob 32 is screwed into the nut 5 in the large-diameter portion 11121 of the stepped through hole 1112 of the connector fixing boss part 111 through the through hole 123 of the terminal part 121. Then, a predetermined position of the male screw part 312 protruding to the back surface side of the housing body 110 from the stepped through hole 1112 of the connector fixing boss part 111 is crimped to prevent the male screw part 312 from slipping out from the stepped through hole 1112 of the connector fixing boss part 111. As a result, the screw-type connector 3 is fixed to the housing body 110 in a posture in which another end surface of the shaft part 311 faces the terminal part 121.

In this state, when the user rotates the large-diameter portion 322 of the knob 32 in a predetermined direction, the small-diameter portion 321 of the knob 32 is inserted into the cover part 112 due to the rotation of the male screw part 312 with respect to the nut 5, and the connector 3 is moved in the direction in which the another end surface of the shaft part 311 is moved toward the terminal part 121.

Next, the layout of the speaker terminals 100A or 100B on the rear panel of the audio device is described.

Figure 4A:
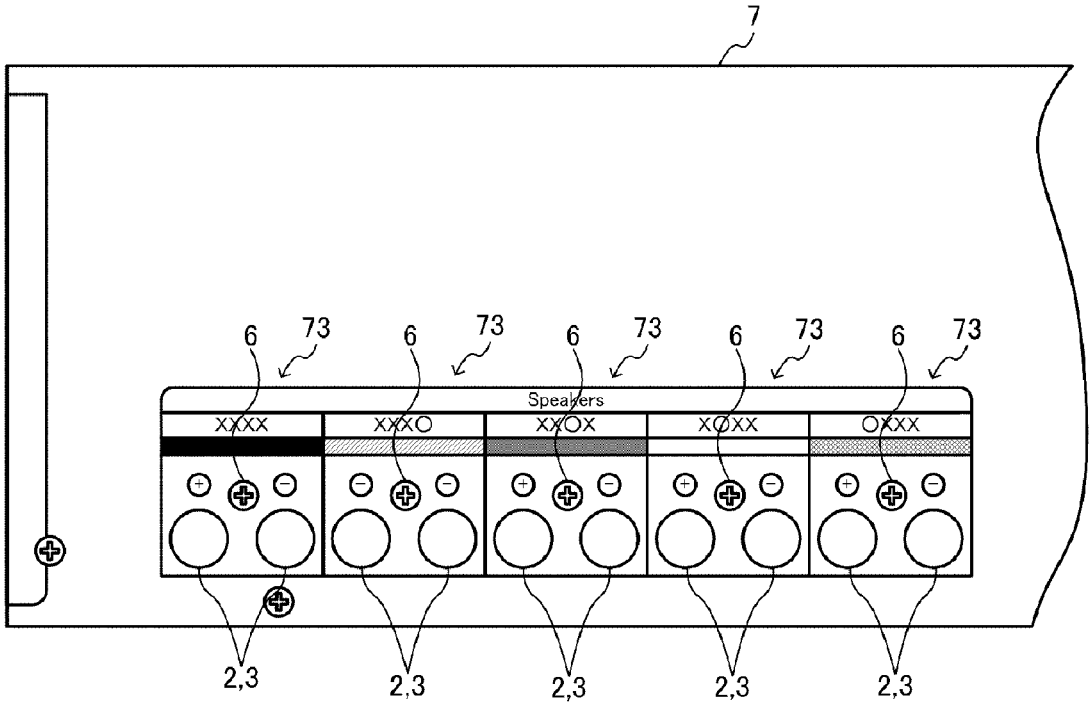
FIG. 4(A) is a diagram for illustrating a partial layout of the speaker terminals 100A or 100B on a rear panel 7 of an audio device.
Figure 4B:
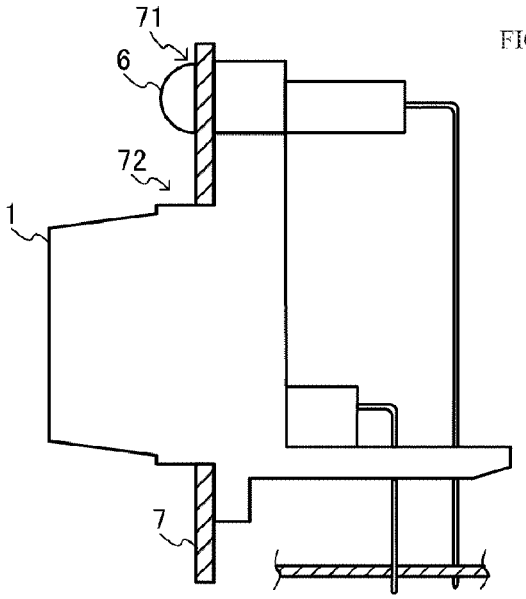
FIG. 4(B) is a diagram for illustrating mounting of the speaker terminal 100A or 100B to the rear panel 7.

FIG. 4 (A) is a diagram for illustrating a partial layout of the speaker terminals 100A or 100B on the rear panel 7 of the audio device, and FIG. 4 (B) is a diagram for illustrating mounting of the speaker terminal 100A or 100B to the rear panel 7.

As illustrated in FIG. 4, two through holes 72 are formed for each audio channel 73 on the rear panel 7 of the audio device. The through holes 72 are arranged in a line in a horizontal direction.

The speaker terminal 100A or 100B of each audio channel connected to the PCB is arranged in the case of the audio device in a posture in which the front surface of the housing body 110 faces the back surface of the rear panel 7 of the audio device. The cover parts 112 of the mounting base 1 and the connectors 2 or 3 of the speaker terminal 100A or 100B are inserted from the back surface side of the rear panel 7 of the audio device into the two through holes 72 of the corresponding audio channel, and protrude on the rear panel 7 side of the audio device.

In this state, the screw 6 inserted into the through hole 71 formed for each audio channel in the rear panel 7 of the audio device is fastened into the screw hole 1141 of the mounting base 1 of the speaker terminal 100A or 100B. Asa result, each speaker terminal 100A or 100B is fixed to the rear panel 7 of the audio device, and the earth lug is grounded to the case of the audio device.

The connectors 2 or 3 of the plurality of speaker terminals 100A or 100B fixed in this manner to the rear panel 7 of the audio device are arranged in a substantially horizontal line on the rear panel 7 of the audio device. As a result, the cable insertion ports 1121 of the cover part 112 of each speaker terminal 100A or 100B are open in an upward direction and in a downward direction, respectively, and hence the upper side of the cable insertion port 1121 is not closed by the connector 2 or 3 of any speaker terminal 100A or 100B. Consequently, the user can smoothly insert the core exposed at the tip of the speaker cable from the upper side toward the lower side into the cable insertion port 1121 of the cover part 112 of the intended speaker terminal 100A or 100B without interfering with the connector 2 or 3 of another speaker terminal 100A or 100B.

As described above, according to this embodiment, a common mounting base 1 is shared by the push-type speaker terminal 100A and the screw-type speaker terminal 100B, and hence any of the push-type and screw-type connectors 2 and 3 may be mounted to the common mounting base 1. As a result, a common PCB may be shared by the push-type speaker terminal 100A and the screw-type speaker terminal 100B. For example, because the push-type and the screw-type connectors 2 and 3 may be used differently for the common mounting base 1, so-called PCB compatibility can be realized among products having different types of speaker terminals mounted thereon. As a result, the common PCB can be shared regardless of product models, such as intended markets and classes, thereby being capable of reducing production costs. Further, a PCB-compatible design can be realized among different product models, thereby being capable of improving design efficiency.

Further, in the push-type speaker terminal 100A, except for an exposed area from the cable insertion ports 1121 of the resin cover part 112, the stud 21 protruding from the resin cap 22 is protected by the resin cover part 112 and the resin cap 22. As a result, during cable connection, the stud 21, which is a hot metal part, can be more reliably prevented from coming into contact with the terminal part of the connection cable, such as an HDMI (trademark) cable and a USB cable. Consequently, reliability is further improved. This is also the case for the screw-type speaker terminal 100B, in which the hot metal part is protected by the resin knob 32 and the resin cover part 112.

Further, for any of the push-type and the screw-type speaker terminals 100A and 100B, the cable insertion ports 1121 of the cover part 112 are oriented in a direction perpendicular to the direction of the arrangement of the two connectors 2 or 3. As a result, for example, when the connectors 2 or 3 of the plurality of speaker terminals 100A or 100B are arranged in a horizontal line on the rear panel 7 of the audio device (horizontal layout), the user can smoothly insert the core of the speaker cable from the upper side toward the lower side into the cable insertion port 1121 of the intended speaker terminal 100A or 100B without interfering with the connector 2 or 3 of another speaker terminal 100A or 100B. Consequently, operability when connecting the cable is improved.

Note that, in this embodiment, the cable insertion ports 1121 of the cover part 112 are open in the direction perpendicular to the direction of the arrangement of the connectors 2 or 3. However, the present invention does not need to be configured in this manner. The direction of the cable insertion ports 1121 of the cover part 112 may be appropriately determined based on the layout and the like of the speaker terminals 100A or 100B on the rear panel 7 of the audio device, for example.

In this embodiment, an example is described above in which the present invention is applied to the speaker terminals 100A and 100B to be used in an audio device. However, the present invention is not limited to the speaker terminal, and the present invention may be applied to various terminals in which push-type and screw-type connectors coexist.

REFERENCE SIGNS LIST

1: mounting base, 2: push-type connector, 3: screw-type connector, 4, 5: nut, 6: screw, 7: rear panel, 11: housing, 12: terminal plate, 21: stud, 22: cap, 23: latch, 31: stud, 32: knob, 71, 72: through hole, 73: audio channel, 100A: push-type speaker terminal, 100B: screw-type speaker terminal, 110: housing body, 111: connector fixing boss part, 112: cover part, 113: snap-fit part, 114: lug fixing boss part, 115: lug holding part, 121: terminal part, 122: leg part, 123: through hole, 124: locking claw, 211: shaft part, 212: male screw part, 221: top part, 222: cylindrical part, 224: cable insertion port, 311: shaft part, 312: male screw part, 313: banana plug insertion port, 321: small-diameter portion, 322: large-diameter portion, 1111: terminal insertion slot, 1112: stepped through hole, 1113: groove, 1141: screw hole, 1121: cable insertion port, 1142: lug insertion slot, 1211: through hole, 2111: cap holding part, 2112: fixing part, 2113: latch insertion hole, 2114: cable insertion hole, 2115: flat surface, 11121: large-diameter portion, 11122: small-diameter portion, 11123: flat surface

The invention claimed is:

1. A terminal mounting base, to which two connectors each being configured to electrically connect an externally inserted cable and a terminal member to each other are to be mounted, the terminal mounting base comprising:

two of the terminal members arranged corresponding to the two connectors, respectively; and a housing comprising terminal fixing parts for the two of the terminal members, which are configured to fix the two of the terminal members, the housing being configured so that, as the two connectors, a screw-type connector and a push-type connector are mountable to the housing, each of the two of the terminal members having a through hole formed therein, each of the terminal fixing parts of the housing having a stepped through hole formed therein to be connected to the through hole of the each of the two of the terminal members, the stepped through hole comprising:

a first hole portion configured to receive a nut threadedly engageable onto, when a metal member of the screw-type connector is inserted into the stepped through hole of the each of the terminal fixing parts through the through hole of the each of the two of the terminal members, a screw part formed on the metal member so that the screw-type connector is moved in a direction in which the externally inserted cable is pushed against the each of the two of the terminal members, or in a direction in which the externally inserted cable is moved away from the each of the two of the terminal members; and a second hole portion having a smaller diameter than the first hole portion, the second hole portion comprising a rotation stopping portion formed in an inner wall thereof, which is configured to prevent rotation of the push-type connector by coming into contact with, when a metal member of the push-type connector is inserted into the stepped through hole of the each of the terminal fixing parts through the through hole of the each of the two of the terminal members, a rotation stopped portion formed on the metal member.

2. A terminal mounting base according to claim 1, wherein the push-type connector and the screw-type connector each comprise a resin part configured to cover one end portion of the metal member, wherein the housing comprises resin covers each having a cable insertion port for inserting the externally inserted cable, the resin covers each being configured to surround a periphery of the each of the terminal fixing parts, and wherein the resin covers are each configured to surround a periphery of a metal part protruding from the resin part when another end portion of the metal member is inserted into the stepped through hole of the each of the terminal fixing parts through the through hole of the each of the two of the terminal members.

3. A terminal mounting base according to claim 2, wherein the cable insertion port of each of the resin covers is oriented in a direction substantially perpendicular to a direction in which the two connectors are arranged.

4. A terminal, comprising:

the terminal mounting base of claim 1; and a push-type connector or a screw-type connector, which is mounted to the terminal mounting base.

5. An audio device, comprising a plurality of the terminals of claim 4, the plurality of the terminals being arranged in a line so that the cable insertion port of the each of the resin covers of the two connectors is oriented in an upward direction.

* * * * *